US010654013B1

(12) United States Patent
Palmer et al.

(10) Patent No.: US 10,654,013 B1
(45) Date of Patent: May 19, 2020

(54) AUTOMATED FLUID MANAGEMENT SYSTEMS AND ASSOCIATED METHODS

(71) Applicants: Andrew Douglas Palmer, Winter Springs, FL (US); Victor Matayoshi De Marco, Orlando, FL (US)

(72) Inventors: Andrew Douglas Palmer, Winter Springs, FL (US); Victor Matayoshi De Marco, Orlando, FL (US)

( * ) Notice: Subject to any disclaimer, the term of this patent is extended or adjusted under 35 U.S.C. 154(b) by 247 days.

(21) Appl. No.: 15/952,138

(22) Filed: Apr. 12, 2018

Related U.S. Application Data

(60) Provisional application No. 62/485,161, filed on Apr. 13, 2017.

(51) Int. Cl.
*B01F 11/00* (2006.01)
*B01F 13/10* (2006.01)
*B01F 15/02* (2006.01)

(52) U.S. Cl.
CPC ..... *B01F 13/1055* (2013.01); *B01F 11/0062* (2013.01); *B01F 11/0097* (2013.01); *B01F 15/026* (2013.01); *B01F 15/0222* (2013.01); *B01F 15/0292* (2013.01)

(58) Field of Classification Search
None
See application file for complete search history.

(56) References Cited

U.S. PATENT DOCUMENTS 677,751 A * 7/1901 Baron ..... A47J 31/401 222/129.4
2,548,106 A * 4/1951 Hancock ..... B01F 13/1072 366/141
4,526,215 A * 7/1985 Harrison ..... B01F 13/1055 141/83
5,727,609 A * 3/1998 Knight ..... B65G 47/901 141/104
2006/0118581 A1* 6/2006 Clark ..... B01F 13/1055 222/333
2007/0012378 A1* 1/2007 Miller ..... B01F 13/1055 141/104

FOREIGN PATENT DOCUMENTS

EP 2236201 A1 * 10/2010 ..... B01F 15/00194

* cited by examiner

*Primary Examiner* — Jennifer A Leung

(57) ABSTRACT

An automatic fluid mixing and dispensing apparatus using a minimum of two powered actuating mechanisms to retrieve fluids from a plurality of fluid containers, mix said fluids, and dispense said fluids into a plurality of dispensed fluid containers. Fluids are stored until requested and mixed in accordance with operator input.

8 Claims, 13 Drawing Sheets

AUTOMATED FLUID MANAGEMENT SYSTEMS AND ASSOCIATED METHODS

CROSS-REFERENCE TO RELATED APPLICATION

Provisional Patent Application No. 62/485,161

BACKGROUND OF THE INVENTION

1. Field of the Invention

This invention relates to gravity fed, simultaneous multi-user, automated, portable, fluid storage, fluid mixing, and fluid dispensing devices. Fluids, for the purposes of this invention, may include such compounds as those used in alcoholic or non-alcoholic beverages, gaseous mixtures, consumable or non-consumable fluid-based products, consumable or non-consumable gravity deliverable solid compounds or mixtures that are able to be poured and/or flow in a similar fashion to fluids, or other fluid chemical mixtures.

2. Description of Related Art

In the field of fluid dispensing apparatus, some historical methods automate the dispensing of fluids and other historical methods, finding that adequate mixing is not achieved by simply dispensing multiple fluids into a final dispensed fluid container, introduce the ability to automate the mixing process of the fluid prior to dispensing. Some of the prior art accomplishes dispensing by that of being gravity fed, using pressurized gases, or using pumps to draw or push the fluid from their fluid containers. Such apparatus makes use of an arrangement of fluid containers, each of which with an electro-mechanically powered actuation mechanism, often either a solenoid valve or pump, used in conjunction with a timing signal from a microprocessor to produce or cease a flow of fluid when activated or deactivated in such a way as to meter the fluid volume and flow rate as it is dispensed. Often the microprocessor is tasked with storing data such as mixture recipes, sales information, and inventory information, as well as manage the operation of a user interface such as a keyboard and display.

Some early examples of this type of apparatus are related to alcoholic beverages and attempt to address the common issues associated with a human bartender such as under or over pouring of ingredients, the speed limitations of a human bartender, and the difficulty in recalling an ever-increasing number of recipes of cocktails. These issues are common among various applications of fluid mixing and dispensing apparatus.

In some of the prior art, each of the individual fluid container requires its own individual powered actuation mechanism, such as a solenoid valve, pump, or motor, at a substantial increase of cost and complexity per fluid container. Additionally, if the apparatus intends to mix or agitate the fluid or combinations of fluids, another powered actuation mechanism, such as a complex electro-mechanical mixing valve or a motor and agitator combination, is utilized, again at a substantial increase of cost and complexity for the apparatus. Additionally, in several cases of the prior art, several additional powered actuation mechanisms, such as solenoid valves, are used to direct and route fluid along specific paths to specific dispensed fluid containers, again at a substantial increase of cost and complexity to the apparatus. Additionally, in some cases of the prior art, another final powered actuation mechanism is used in the process of dispensing the fluid after mixing, generally to open a dispensing solenoid valve or to activate an additional dispensing pump, again at a substantial increase of cost and complexity to the apparatus. This requires the apparatus include numerous powered actuation mechanisms (i.e. motors, solenoid valves, pumps, etc.) to accomplish all of the operations involved in fluid storing, mixing, and dispensing. With the method of construction used in the prior art, both the cost and maintenance needs of the apparatus greatly increase with the addition of each additional fluid container and capability to the system.

In some of the prior art, microprocessor computing devices are used to direct the powered actuation mechanisms of the apparatus. The cost of micro-processing power and complexity increase with each addition of another powered actuation mechanism.

In some of the prior art, single user interfaces are implemented in order to operate the apparatus. These types of single user interfaces, whether they be analog knobs and dials or digital computer interfaces, only allow for one user to interact with the apparatus at a time. This slows the process of inputting additional information, i.e. recipes, orders, maintenance instructions, etc., and therefore often creates a longer, slower, and inconvenient user queue.

BRIEF SUMMARY

Apparatus for the storage of various fluids in a multitude of fluid containers and the subsequent retrieval of the fluid from the fluid containers for the purposes of mixing and then dispensing the fluid into additional dispensed fluid containers. The apparatus additionally includes a self-rinsing process and a simultaneous multi-user interface system.

The methods of fluid storage, retrieval, mixing, dispensing, and self-rinsing are accomplished by the use of, at a minimum of, only two powered actuations mechanisms to propel a primary and secondary carriage to conduct all of the necessary operations therein.

The method of fluid storage is accomplished by a plurality of an arrangement of primary fluid containers or wash bottle fluid containers, each with their own fluid retrieval valve, all supported by the structure of the frame.

The method of fluid retrieval is accomplished by one or more fluid collection mechanisms that are attached to one or more fluid retrieval members which extends from and is attached to a secondary carriage that traverses upon a set of secondary guidance members where the secondary guidance members are attached to a primary carriage that traverse upon a set of primary guidance members where the primary guidance members are attached to the frame, wherein the combination of motions of the primary and secondary carriages along their respective primary or secondary guidance members allow the fluid collection mechanism to be maneuverable along the paths of the primary and secondary guidance members to align with and engage the plurality of primary fluid containers' fluid retrieval valves. The motion of the primary and/or secondary carriages are utilized to impart a physical force to operably engage the fluid retrieval valves of each of the plurality of primary fluid containers and permit the flow of fluid to the fluid collection mechanism. A fluid collection mechanism is in fluid connection with the fluid transmission mechanism(s) and the fluid transmission mechanism(s) is in connection with the fluid mixing container, whereby the chain of connections allows fluid to pass from the fluid connection mechanism(s) to the fluid mixing container(s).

The method of fluid mixing is accomplished by utilizing the motion of the primary and/or secondary carriages to mix or agitate the fluid contained within the fluid mixing container.

The method of dispensing is accomplished by utilizing the motion of the primary and/or secondary carriages to (a) align the fluid dispensing valve of the fluid mixing container with any one of the plurality of dispensed fluid containers and then to (b) impart a physical force to operably engage the fluid dispensing valves of each of the plurality of fluid mixing containers and permit the flow of fluid to the dispensed fluid container(s).

The method of self-rinsing is accomplished by the same method as that of the method of fluid retrieval discussed above, however the operable engagement is conducted with the fluid retrieval valve of one or more wash bottle fluid containers rather than a primary fluid container as discussed in the fluid retrieval method. By use of one or more separate wash bottle fluid containers and their accompanying fluid retrieval valves, all of the surfaces making contact with the fluid may be rinsed with sanitizing solutions thereby accomplishing the self-rinsing process.

An optional tertiary powered actuation mechanism can be utilized to reduce the travel time and distance between any two primary fluid containers or wash bottle fluid containers by allowing the fluid retrieval member to reposition itself into a stored position via the motion of the tertiary powered actuation mechanism in order to allow for direct line of sight travel rather than requiring a path around the individual primary fluid containers and/or wash bottle fluid containers.

A simultaneous multi-user method for user interaction with the apparatus is accomplished through the use of multiple off-board computing devices that may communicate with the on-board microprocessor to exchange instructions, machine status, or other useful information with the plurality of users. The microprocessor is used to direct and operate the various powered actuation mechanisms of the apparatus.

BRIEF DESCRIPTION OF THE DRAWINGS

FIGS. 3A, 3B, and 3C are fragmentary perspective front views of the embodiment shown in FIG. 1 that illustrate the movements of the secondary carriage and fluid retrieval member, in which FIG. 3A shows the secondary carriage in position with respect to a primary fluid container, FIG. 3B shows a rotated fluid retrieval member in alignment with a fluid retrieval valve, and FIG. 3C shows the movement of the secondary carriage as a means for the fluid retrieval member to engage the fluid retrieval valve.

FIGS. 4A and 4B are front section views of the embodiment shown in FIG. 1 that illustrate the actuation of the fluid retrieval valves, in which FIG. 4A shows the fluid retrieval valve in a normally closed position and FIG. 4B shows the fluid retrieval valve actuated into an open position.

FIGS. 6A and 6B are front views of the embodiment shown in FIG. 1 with the fluid mixing container shown in partial section view that illustrate the actuation of the fluid mixing container's fluid dispensing valve, in which FIG. 6A shows the fluid mixing container's fluid dispensing valve in a normally closed position with the secondary carriage in position above the fluid dispensing valve's actuation member and FIG. 6B shows the fluid mixing container's fluid dispensing valve actuated into an open position by the secondary carriage's contact with the valve actuation member.

Figure 1:
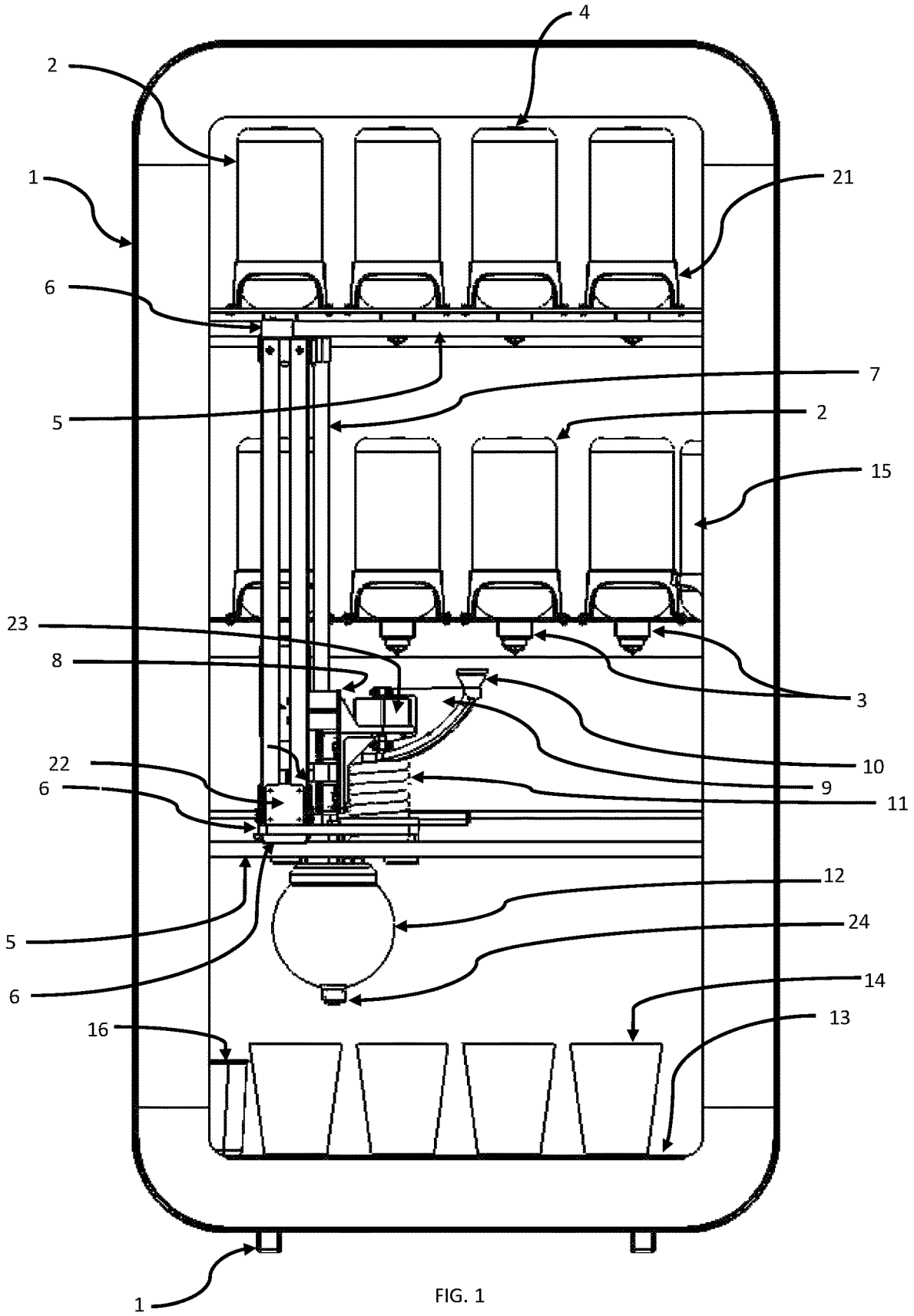
FIG. 1 is showing a front view outline of an embodiment of a fluid storage, fluid retrieval, fluid mixing, and fluid dispensing apparatus according to the invention.
Figure 2A:
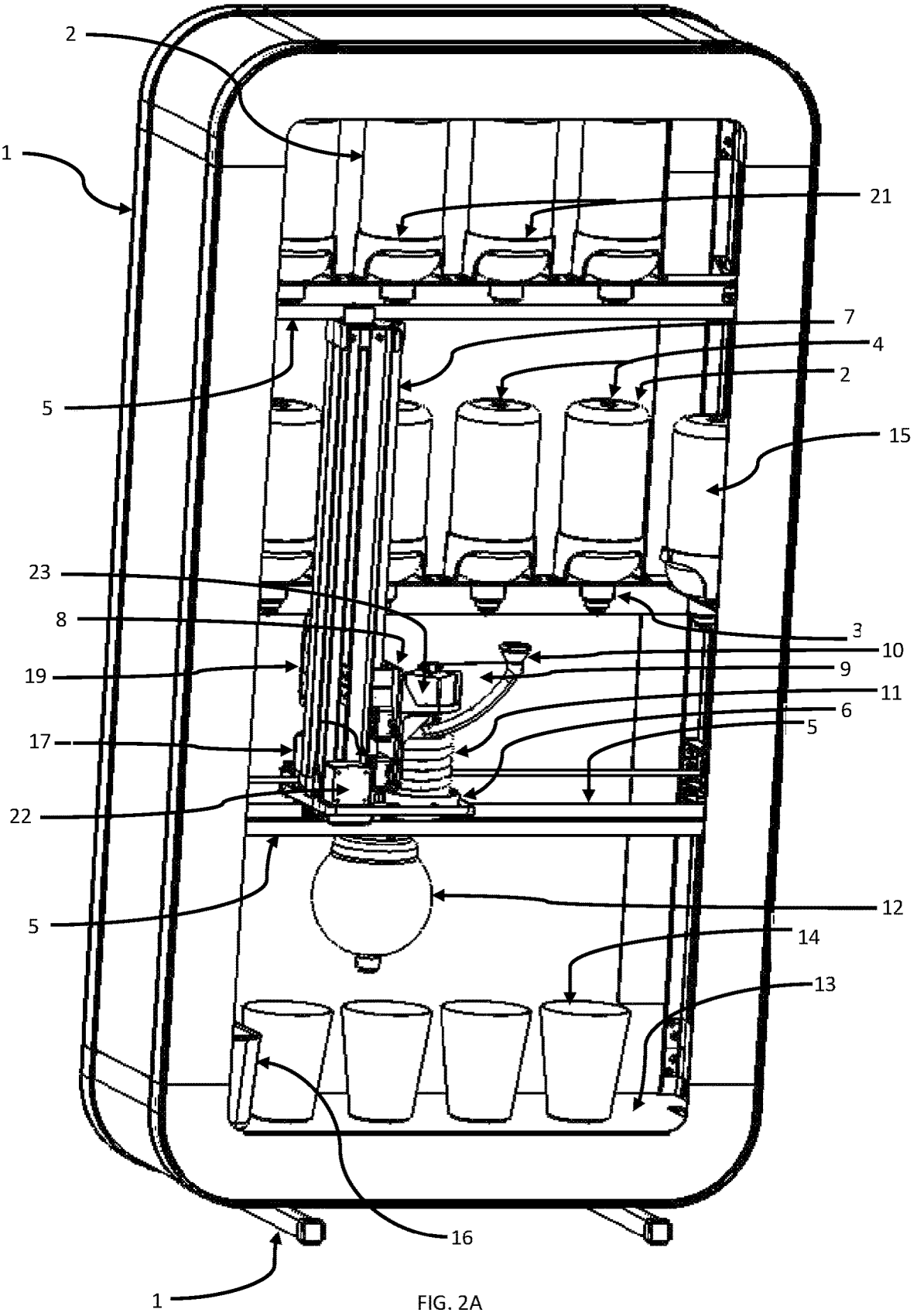
FIGS. 2A and 2B are perspective front views of the embodiment shown in FIG. 1 that illustrate the movement of the secondary carriages along the secondary guidance elements.
Figure 2B:
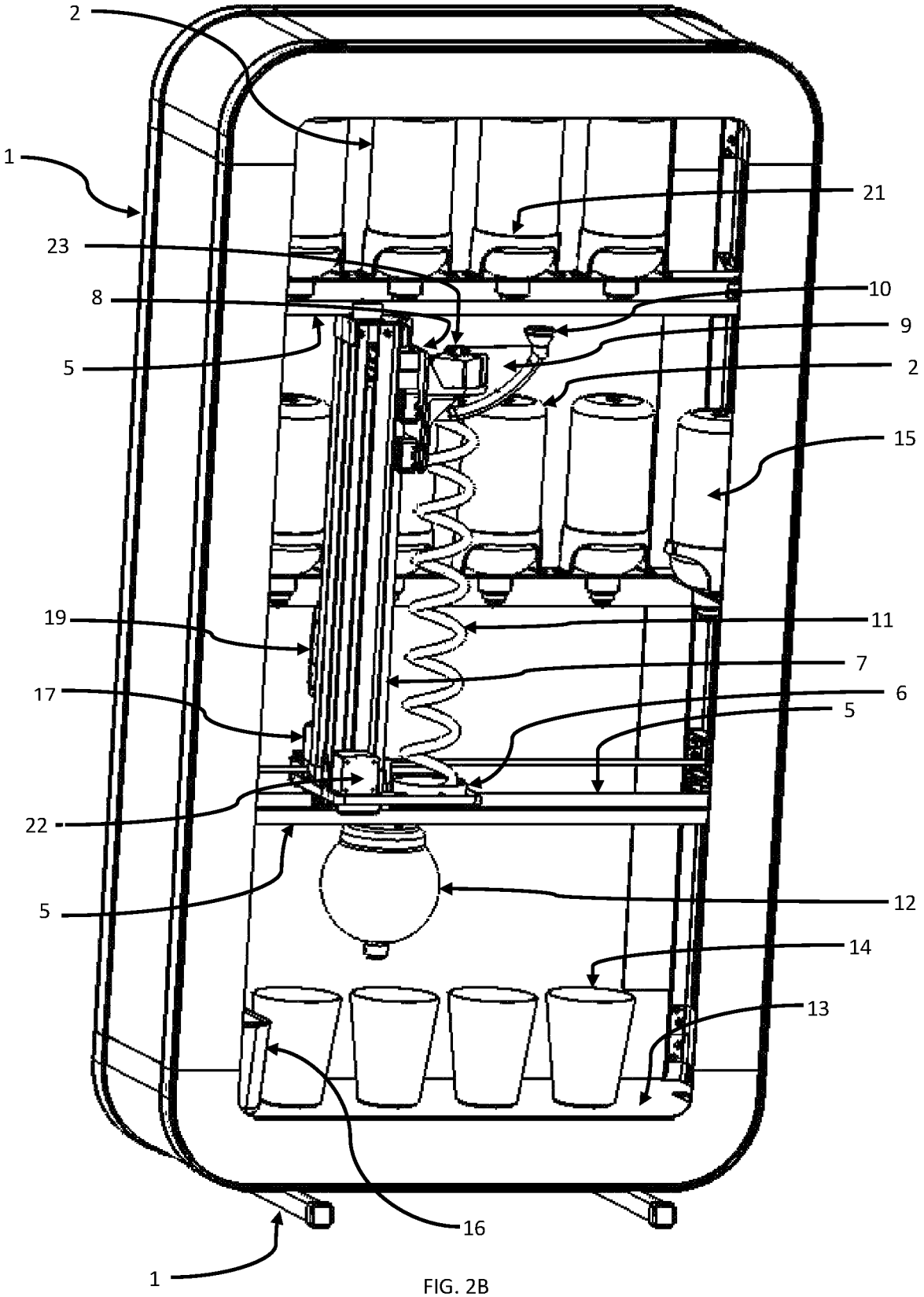
Figure 3A:
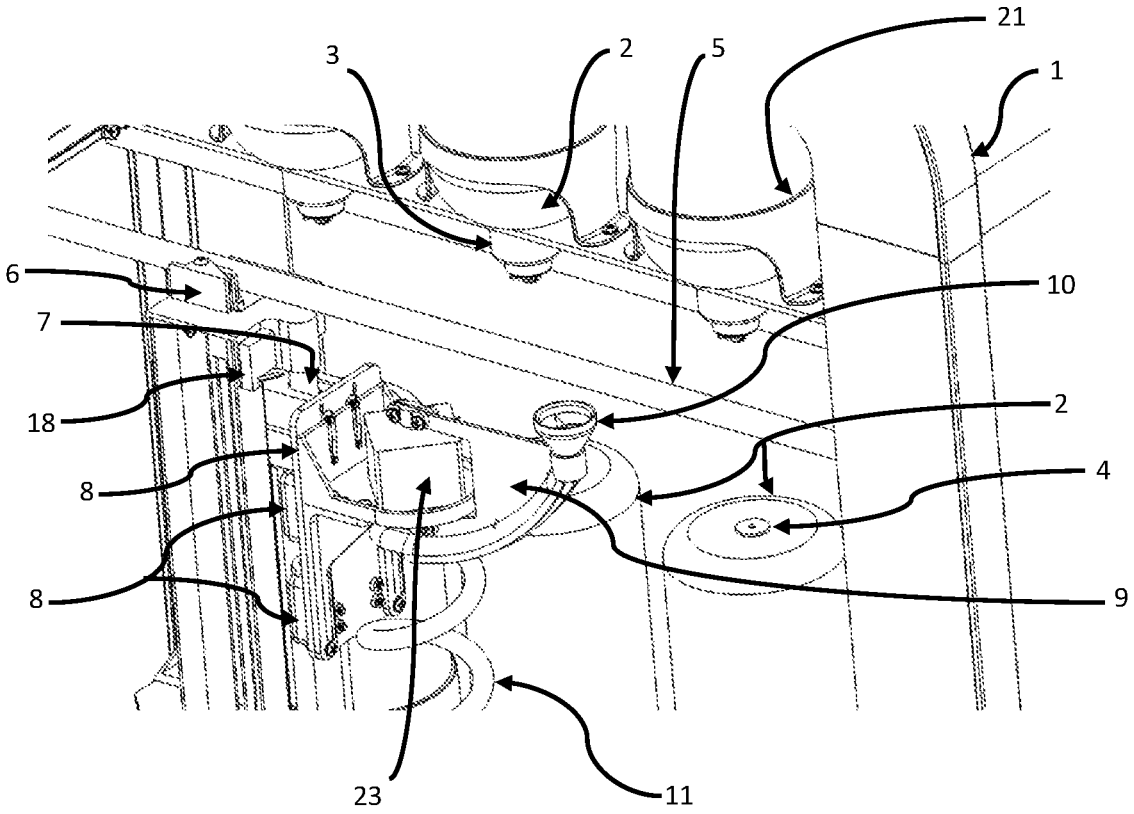
Figure 3B:
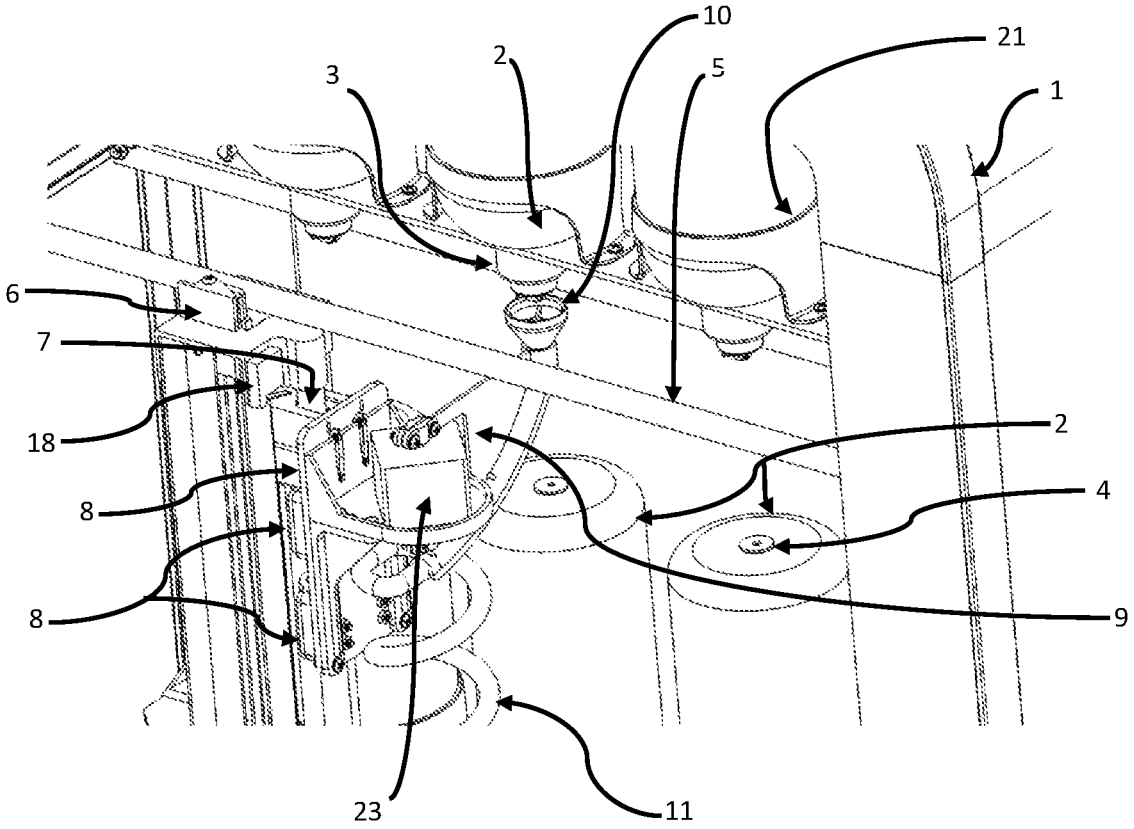
Figure 3C:
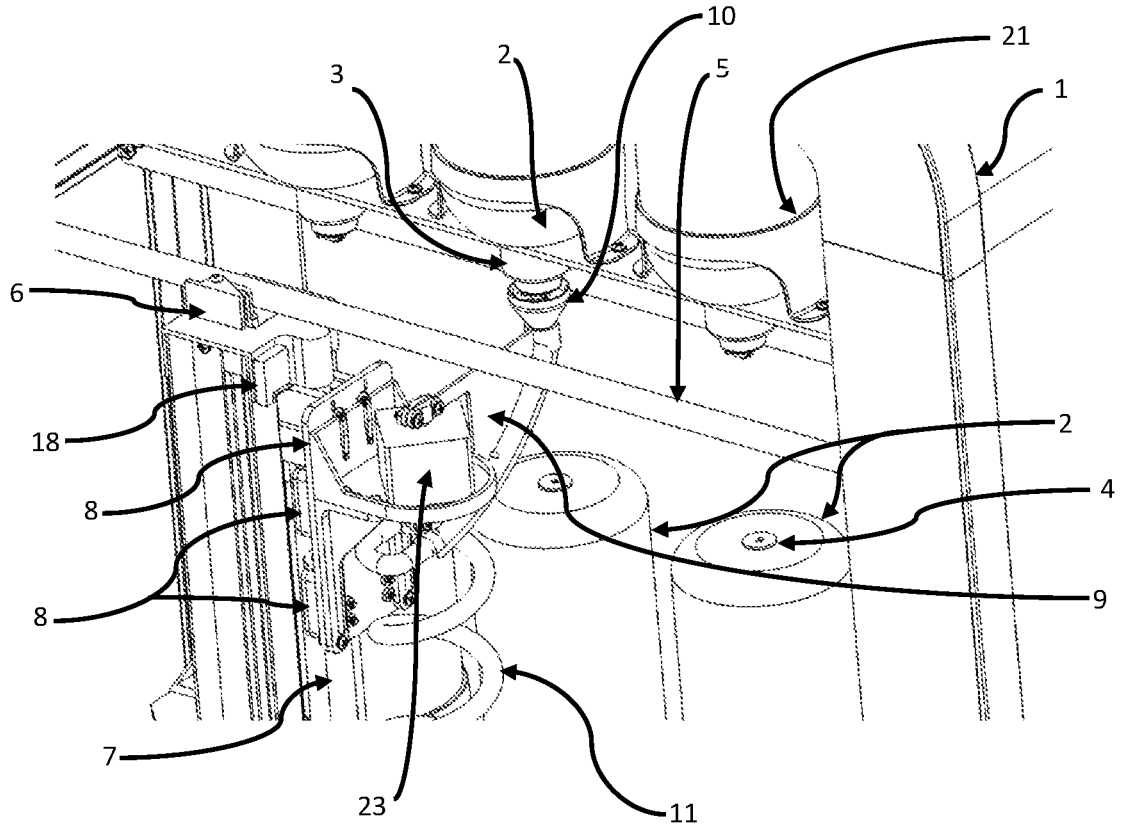
Figure 4A:
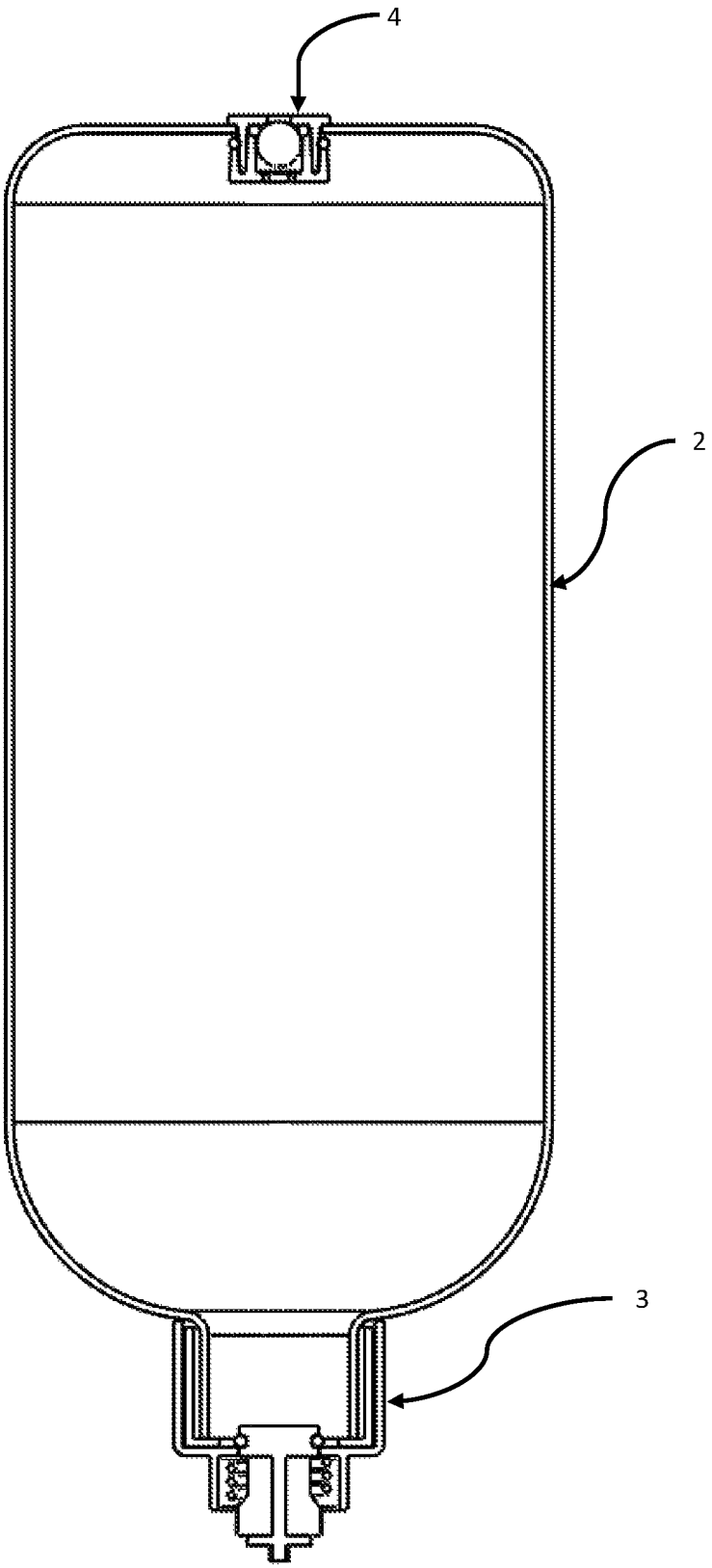
Figure 4B:
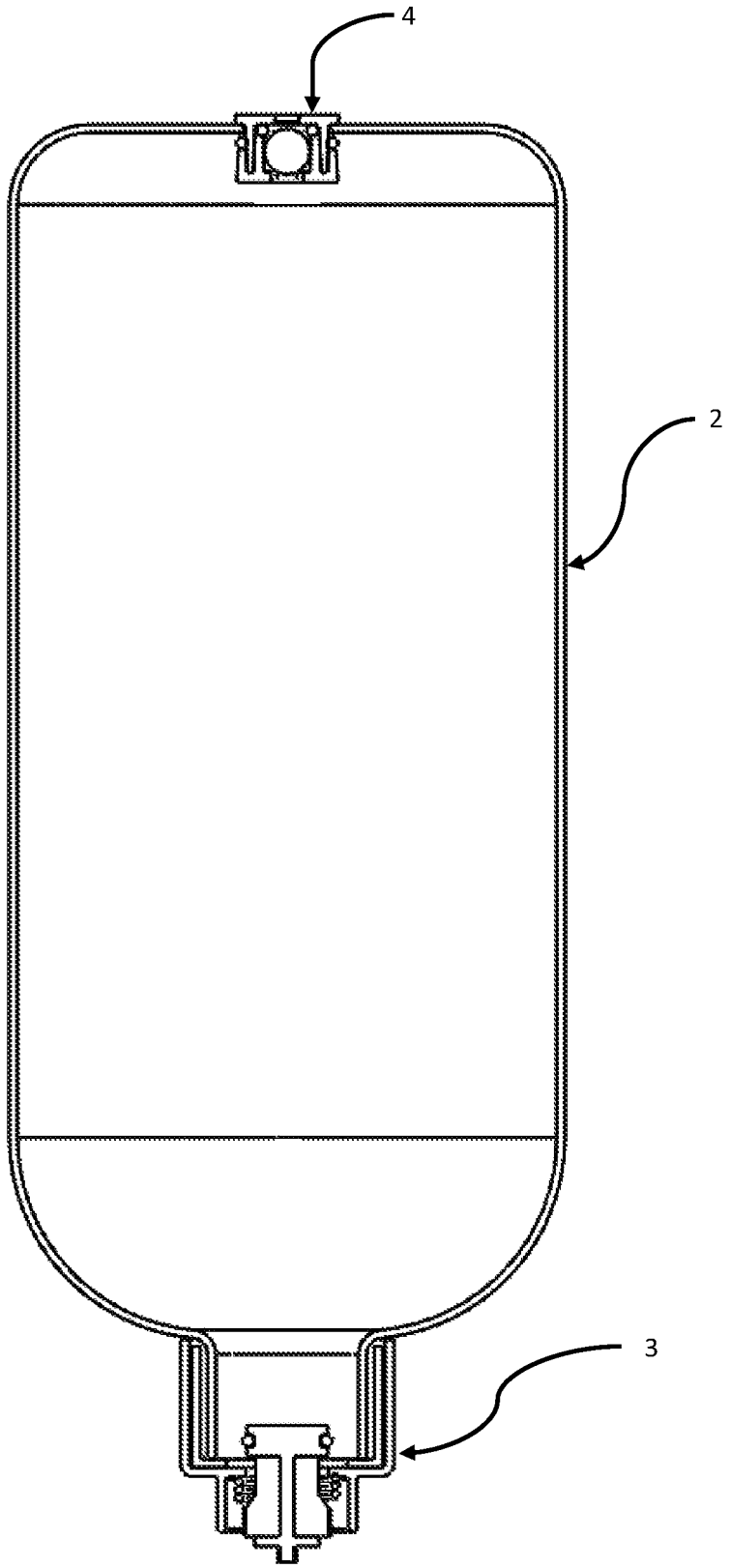
Figure 5A:
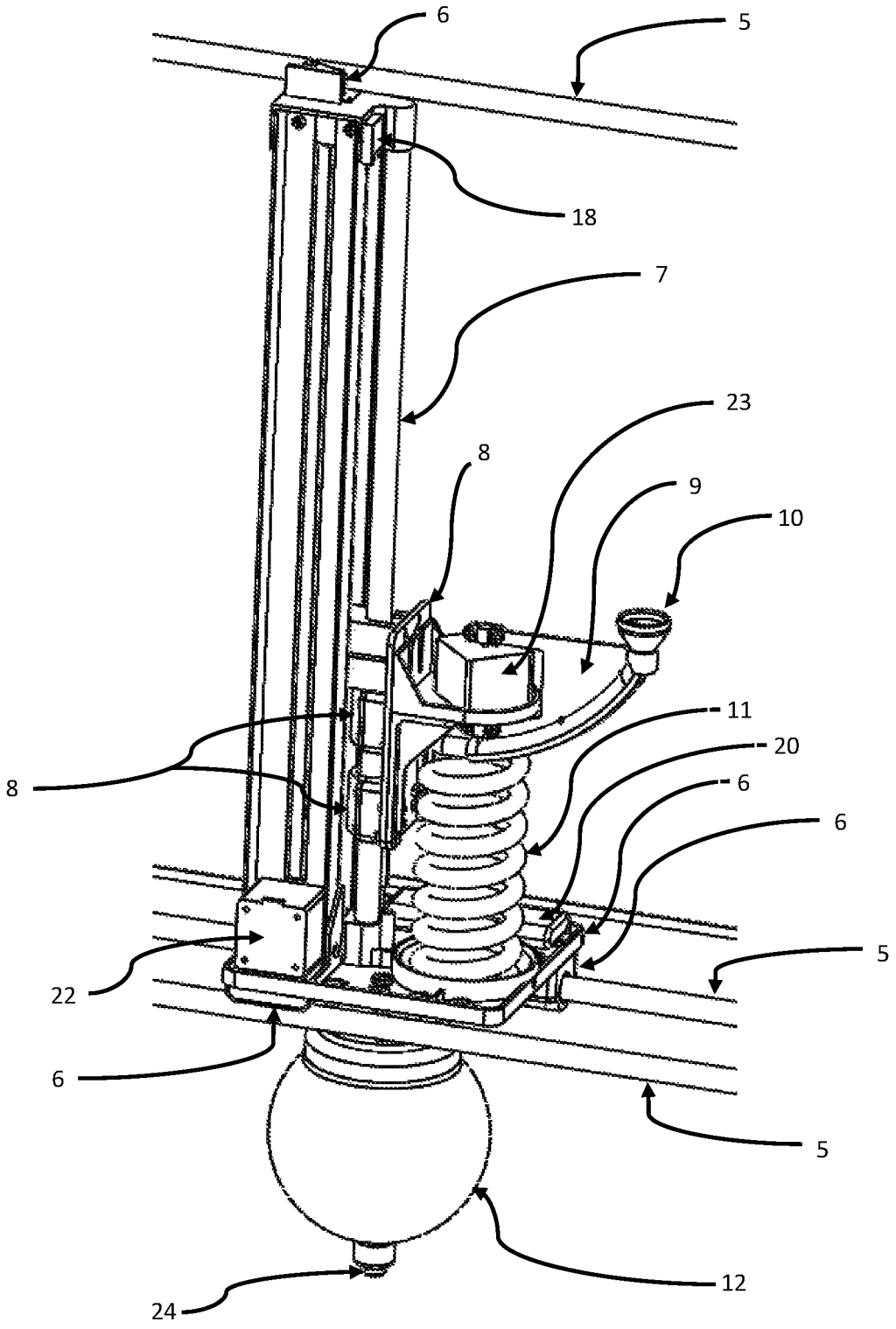
FIGS. 5A and 5B are fragmentary perspective front views of the embodiment shown in FIG. 1 that illustrate the movements of the secondary carriage.
Figure 5B:
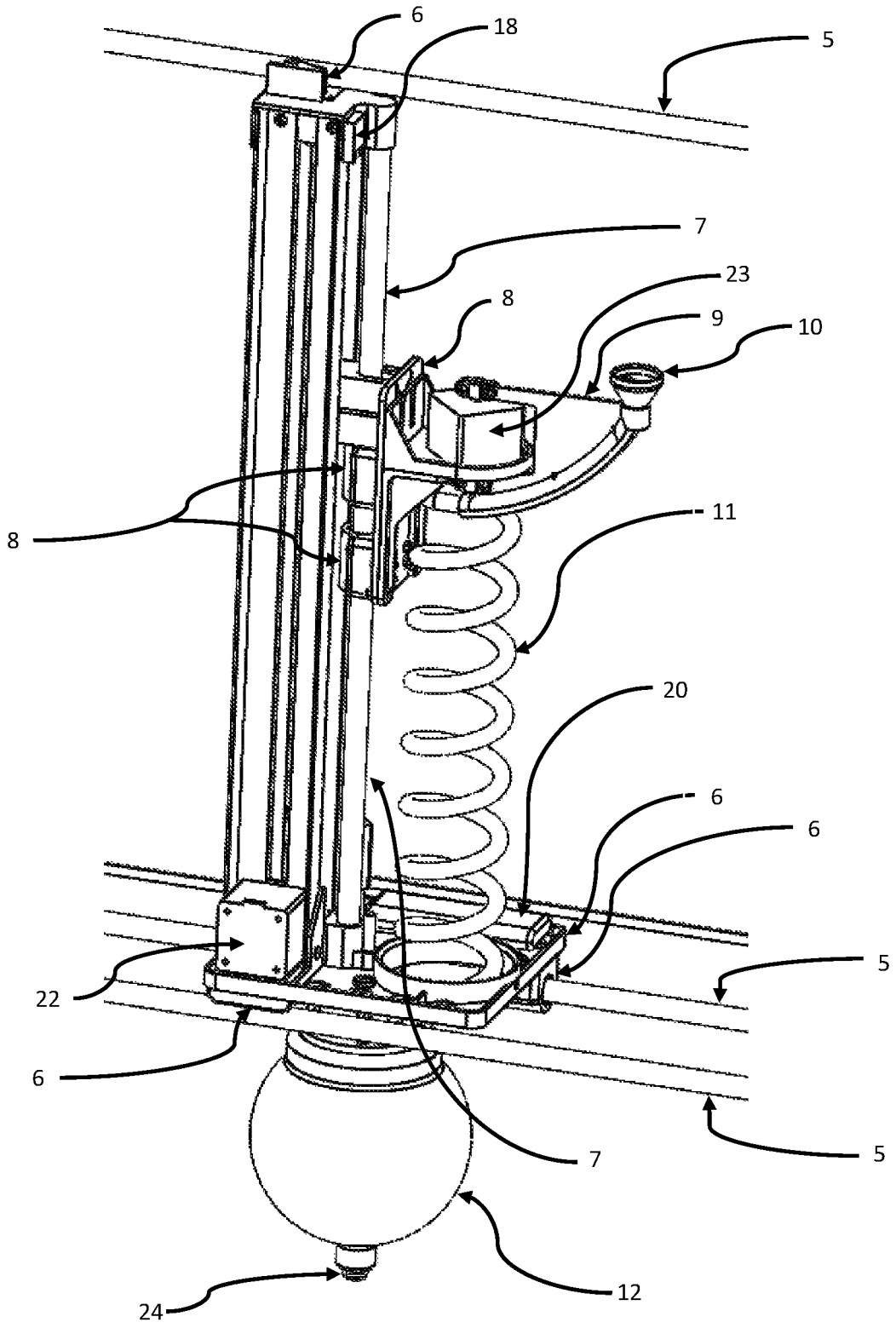
Figure 6A:
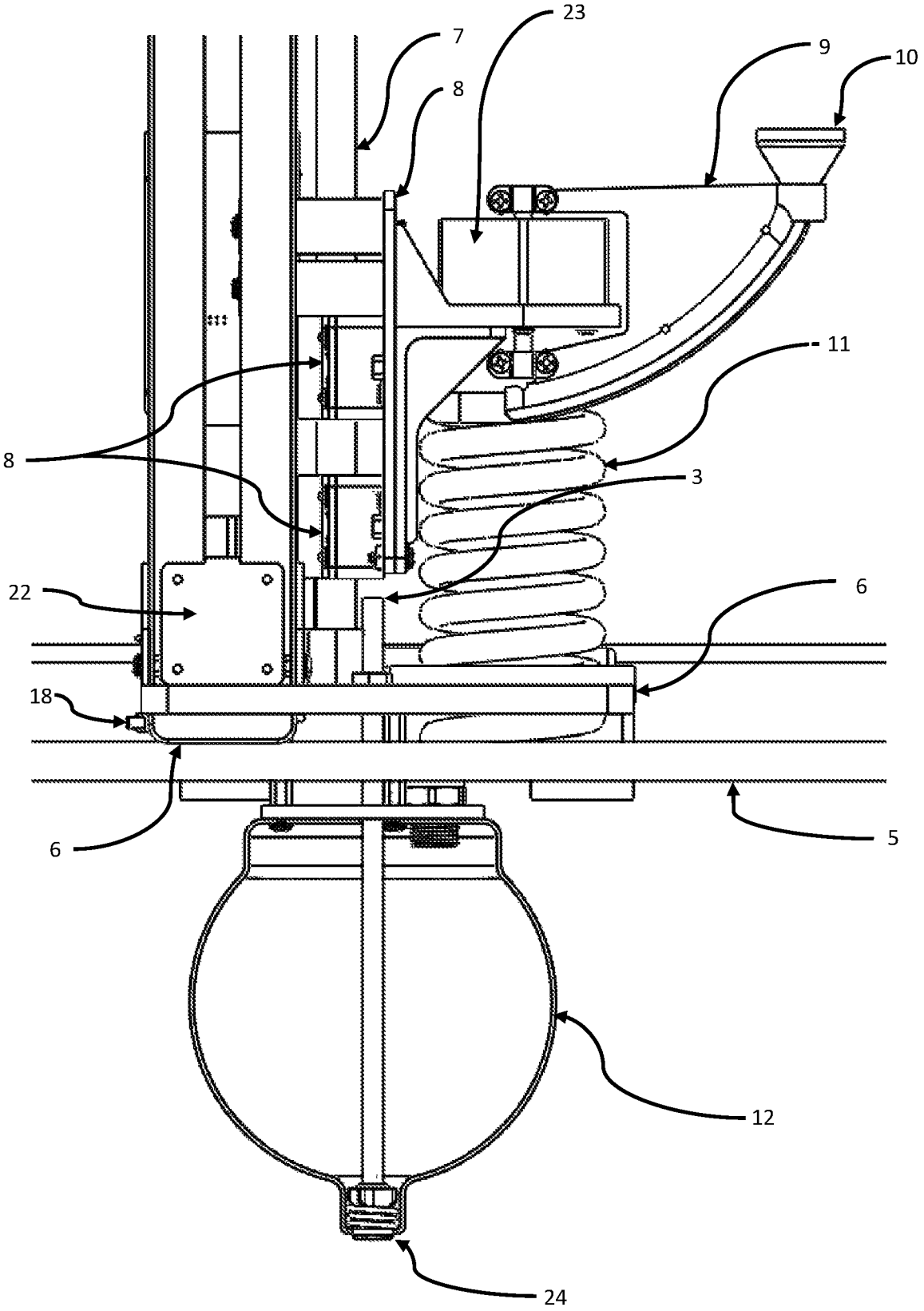
Figure 6B:
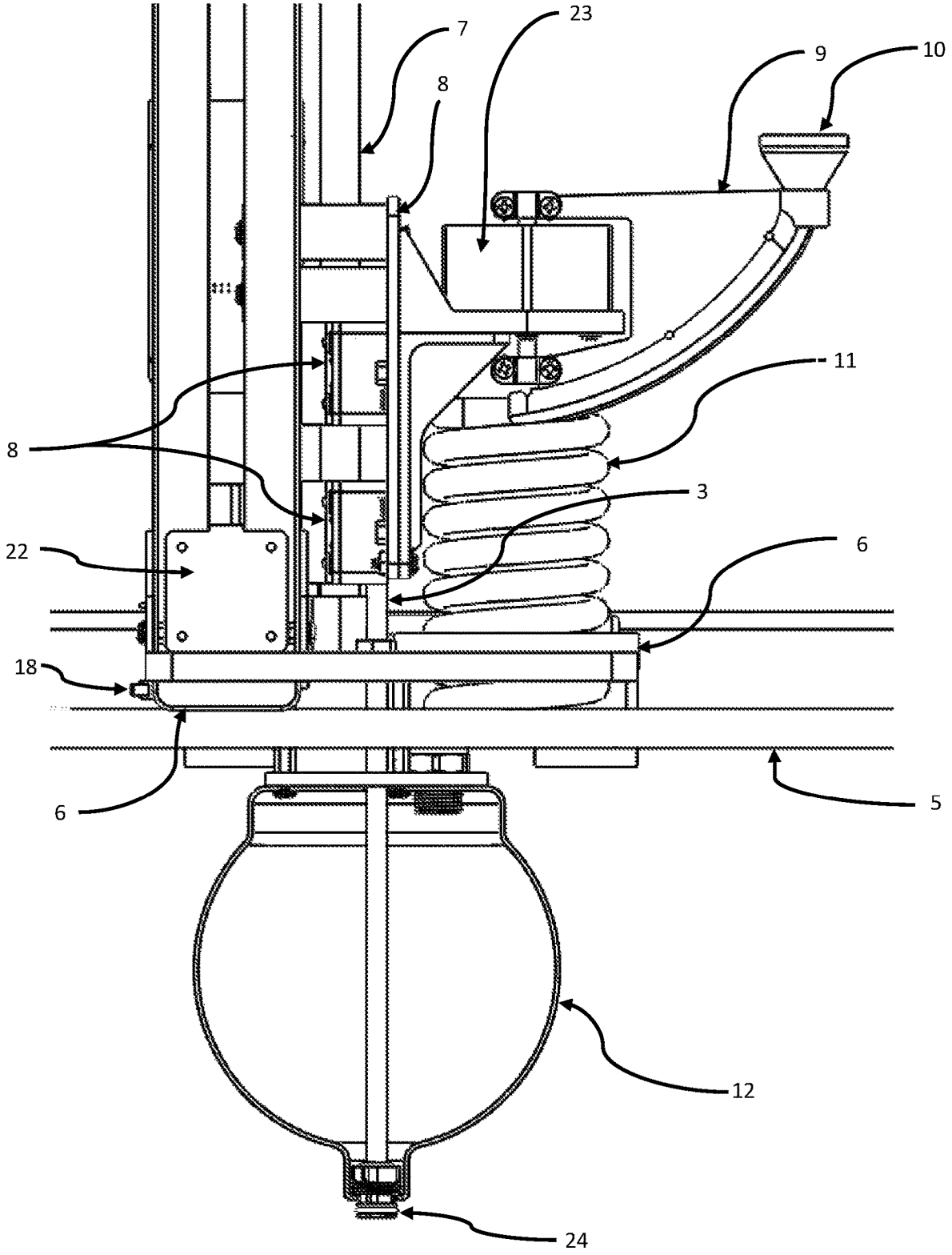
Figure 7:
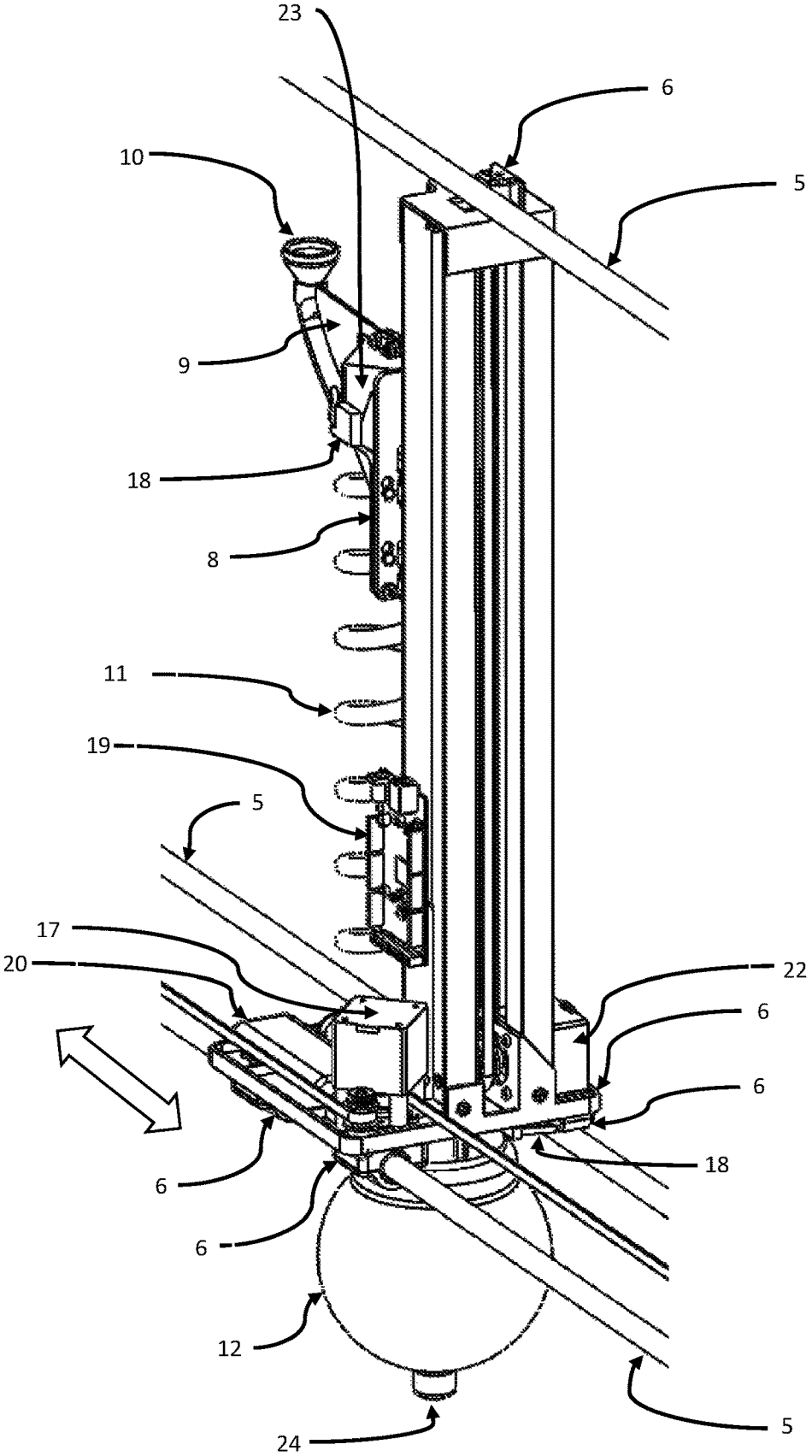
FIG. 7 is a fragmentary perspective rear view of the embodiment show in FIG. 1 that shows features and components of the apparatus obscured in FIG. 1 and a double headed arrow indicates the direction of travel of the primary carriage.

In the figures; item 1 is the frame; item 2 is a primary fluid container; item 3 is a fluid retrieval valve; item 4 is a smooth flow valve; item 5 is a primary guidance member; item 6 is a primary carriage; item 7 is a secondary guidance member; item 8 is a secondary carriage; item 9 is a fluid retrieval member; item 10 is a fluid collection mechanism; item 11 is a fluid transmission mechanism; item 12 is a fluid mixing container; item 13 is a fluid dispensing & distribution platform; item 14 is a dispensed fluid container; item 15 is a wash bottle fluid container; item 16 is a drip & waste container; item 17 is the primary powered actuation mechanism; item 18 is a sensor; item 19 is a microprocessor; item 20 is a power source; item 21 is the fluid container holding mechanism; item 22 is a secondary powered actuation mechanism; item 23 is a tertiary powered actuation mechanism; item 24 is a fluid dispensing valve.

DETAILED DESCRIPTION OF THE VARIOUS EMBODIMENTS OF THE INVENTION

Examples of possible configurations of the apparatus and associated methods will now be discussed in more detail. The examples depicted in the drawings and described below are provided for the purpose of illustration and are not intended to disclose all possible configurations or examples or limit the scope of possible configurations or examples.

In view of the foregoing, what is needed is a fluid dispensing system that is much simpler.

The example embodiments described here provide solutions to address at least one of the problems of the conventional systems by providing a simpler, lower cost apparatus and/or method of gravity fed dispensing, retrieval, mixing, and storage of fluids.

Apparatus for the storage of various fluids in a multitude of fluid containers and the retrieval of the fluid from the fluid containers for the purposes of mixing and dispensing the fluid into additional dispensed fluid containers, the operation of which is conducted through the use of a multi-user software-based method for operating the apparatus.

While several embodiments are described further herein, an example embodiment of the apparatus includes: a frame, being comprised of supporting structures or members; an arrangement of a plurality of primary fluid containers, such as bottles or other like containers; an arrangement of a plurality of fluid container holding mechanisms, such as a grasping mechanism or other stabilizing or positioning mechanism, or cavity, etc.; a plurality of non-powered fluid retrieval valves, such as a spring loaded check valve or the like, for each of the primary fluid containers; one or more wash bottle fluid containers, such as bottles or other like containers; one or more wash bottle fluid container holding mechanisms, such as a grasping mechanism or other stabilizing or positioning mechanism, or cavity, etc. for each of the wash bottle fluid containers; one or more non-powered fluid retrieval valves, such as a spring loaded check valve or the like, for each of the wash bottle fluid containers; a smooth flow valve, such as a check valve, flap valve, umbrella valve, duckbill valve, etc., for each of the primary fluid containers and wash bottle fluid containers; a plurality of primary guidance members, such as rails, tubes, etc. and corresponding path constraining components; a primary carriage, such as a platform or other structure capable of traversing the primary guidance members; a primary powered motion actuation mechanism for the primary carriage, such as an electric motor or actuator and an accompanying belt, spool, lead screw, etc.; a plurality of secondary guidance members, such as rails, tubes, etc. and corresponding path constraining components; a secondary carriage, such as a platform or other structure capable of traversing the secondary guidance members; a secondary powered motion actuation mechanism for the secondary carriage, such as an electric motor or actuator and an accompanying belt, spool, lead screw, etc.; one or more fluid retrieval members, such an arm, jib, boom, etc.; a tertiary powered motion actuation mechanism for the fluid retrieval member, such as an electric motor, servo, etc.; one or more fluid collection mechanisms, such as a cup, funnel, etc.; one or more fluid transfer mechanisms, such as a tube, pipe, etc.; one or more fluid mixing containers, such as a bottle, bowl, or other like container; one or more fluid dispensing valves, such as a spring loaded check valve or the like; one or more fluid dispensing & distribution platforms, such as a plate, panel, or other resting surfaces; an arrangement of dispensed fluid containers, such as cups, bottles, or glasses; a series of fluid container holding mechanisms for the dispensed fluid containers, such as a grasping mechanism or other stabilizing or positioning mechanism, or cavity, etc.; one or more wash bottle fluid containers, such as bottles or other like containers; one or more fluid container holding mechanisms for the wash bottle fluid container, such as a grasping mechanism or other stabilizing or positioning mechanism, or cavity, etc.; a drip & waste container, such as a bottle, bowl, or bin; a fluid container holding mechanism for the drip & waste fluid container, such as a grasping mechanism or other stabilizing or positioning mechanism, or cavity, etc.; a power source, such as a battery or standard wall outlet power; a microprocessor, such as a programmable electronic circuit; an information input device, such as a keyboard, keypad, touchpad, etc.; a display, such as a monitor or other digital information viewing screen; and sensors, such as momentary contact switches, proximity sensors, etc., for detecting the position of the primary carriage, the secondary carriage, and the fluid retrieval member. An example embodiment can also include a method of which information regarding the operations the apparatuses may be used by one or more users through multiple computing devices.

In one embodiment an automated fluid storage, fluid retrieval, fluid mixing, and fluid dispensing apparatus can be provided which comprises a frame structure upon or within which the various elements of the apparatus are attached or held. The frame can house an arrangement of one or more primary fluid containers and wash bottle fluid containers, within which fluid is stored before retrieval, each of the primary fluid containers and wash bottle fluid containers having their own respective fluid retrieval valve, and where the primary fluid containers and wash bottle fluid containers are held to the frame by one or more fluid container holding mechanisms. The frame can house one or more primary guidance members, which are attached to the frame, which allows a corresponding primary carriage to traverse upon the primary guidance members. The frame can house one or more of the secondary guidance members, which are attached to the primary carriage, which allows a corresponding secondary carriage to traverse upon the secondary guidance members. The primary and secondary carriages are propelled along their respective primary and secondary guidance members by their respective primary and secondary powered actuation mechanisms. The fluid collection mechanism can be brought into alignment with any of the plurality of the primary fluid containers or wash bottle fluid containers by use of the translation of the primary and secondary carriages along their respective primary and secondary guidance members. The secondary carriage(s) can have attached one or more fluid retrieval members, emitting from the secondary carriage(s), upon which is a fluid collection mechanism, that operably engages the fluid retrieval valves of the primary fluid containers and wash bottle fluid containers by applying a direct physical force to open the fluid path of the fluid retrieval valves of the primary fluid containers and wash bottle fluid containers, which said force is imparted by the motion of the secondary carriage(s), as they travel along their respective secondary guidance members. The one or more primary fluid containers, wash bottle fluid containers, and fluid mixing containers can have a smooth flow valve to allow air to enter these containers to avoid uneven flow or gurgling of the fluid as it exists the retrieval valve to ensure reliable flow rate-based metering of the fluid. The one or more fluid transmission mechanism(s) provides the fluid a path from the fluid collection mechanism and the fluid retrieval member to a fluid mixing container. The primary carriage can have attached one or more fluid mixing containers, within which fluid is, after being received from the fluid transmission mechanism, stored, and optionally mixed, before being dispensed; each of the fluid mixing containers having their own respective fluid dispensing valve. The fluid mixing container and its accompanying fluid dispensing valve can be brought into alignment with any of the plurality of the dispensed fluid containers by use of the translation of the primary carriage along its primary guidance members. The fluid mixing containers can dispense the fluids contained within by utilizing the motion of the secondary carriage to impart a force on the fluid dispensing valves of the fluid mixing containers to open the fluid pathway of the fluid dispensing valve of the fluid mixing containers, which said force is imparted by the motion of the secondary carriage as it travels along its secondary guidance members. The frame can house one or more fluid dispensing & distribution platforms, where the fluid dispensing & distribution platform(s) are attached to the frame. The fluid dispensing & distribution platform(s) can allow for one or more dispensed fluid containers, within which fluid is, after being received from the fluid mixing container, stored before retrieval by the user, and where the dispensed fluid containers are held to the fluid dispensing & distribution platform by one or more fluid container holding mechanisms. The frame can house one or more drip & waste containers to receive and store excess, dripped, or flushed fluid dispensed from the fluid mixing container for retrieval by the user, and where the fluid waste containers are held to the frame structure by one or more fluid container holding mechanisms.

Another embodiment can provide a tertiary powered actuation mechanism to position one or more fluid retrieval members in a stored or variably extended position with respect to the primary and secondary carriages and the primary fluid containers and/or wash bottle fluid containers.

Another embodiment can provide mixing of the fluid contained within the fluid mixing container by utilizing the transmission of motion of the primary powered actuation mechanism to the primary carriage in order to thereby move the fluid mixing container that is attached to the primary carriage in a manner that allows for mixing and/or agitating of the fluids contained within.

Another embodiment can provide mixing of the fluid contained within the fluid mixing container by utilizing the transmission of motion of the secondary powered actuation mechanism to the secondary carriage in order to thereby move the fluid mixing container that is attached to the secondary carriage in a manner that allows for mixing and/or agitating of the fluids contained within.

Another embodiment allows for the secondary carriage to have one or more fluid retrieval members attached, emitting from the secondary carriage, upon which a fluid collection mechanism exists, that operably engages the fluid retrieval valves of the primary fluid containers and wash bottle fluid containers by applying a direct physical force to open the fluid path of the fluid retrieval valves of the primary fluid containers and wash bottle fluid containers, which said force is imparted by the motion of the primary carriages, as they travel along their respective primary guidance members.

Another embodiment allows for the secondary carriage to have one or more fluid retrieval members attached, emitting from the secondary carriage, upon which a fluid collection mechanism exists, that operably engages the fluid retrieval valves of the primary fluid containers and wash bottle fluid containers by applying a direct physical force to open the fluid path of the fluid retrieval valves of the primary fluid containers and wash bottle fluid containers, which said force is imparted by the motion of the fluid retrieval member, as it is activated into motion by the tertiary powered actuation mechanism.

Another embodiment can provide a method of which the apparatus uses the normal dispensing and mixing operations to flush, clean, and sanitize the surfaces with which the fluids make contact by engaging the wash bottle fluid containers in the same manner as the apparatus would for a primary fluid container.

Another embodiment can provide a microprocessor to send and receive signals to and from the powered sources of motion actuation, sensors, displays, keyboards, off-board interactive computer systems, or combinations thereof.

Another embodiment can provide a method of which information regarding the fluid storage, fluid retrieval, fluid mixing, and fluid dispensing operations of one or more apparatuses may be inputted, wired or wirelessly transmitted, and shared between one or more apparatuses and/or one or more off-board interactive computer systems or mobile devices, and thereby allow multiple simultaneous users.

Another embodiment can make use of an on-board power source or outlet power for the electrical needs of the apparatus.

With the use of the above-mentioned features of the apparatus and method, the total product cost and complexity of a fluid storage, fluid retrieval, fluid mixing, and fluid dispensing device can be significantly reduced through the use of only two powered actuation mechanisms, the primary and secondary powered actuation mechanisms, to accomplish all of the physical actions necessary to retrieve, mix, and dispense a multitude of fluid combinations from a multitude of fluid containers. With the use of only two powered actuation mechanisms, the primary and secondary powered actuation mechanisms, and a fluid collection mechanism being fixed/static with respect to the secondary carriage, the fluid collection mechanism would necessarily be required to travel around the primary fluid containers and wash bottle fluid containers so therefore the addition of a tertiary powered source of motion actuation to allow for the fluid retrieval member to relocate to a stored position, the fluid collection mechanism can then achieve faster travel times when traveling from one primary fluid container to another or to the wash bottle fluid containers thereby eliminating its potential for collision with the primary fluid containers, wash bottle fluid containers, or any of their associated components when traveling in a line of sight manner from one primary fluid container to another or to the wash bottle fluid containers. The apparatus increases the ease of maintenance by automating the cleaning and flushing of the fluid collection mechanism, fluid transmission mechanisms, fluid mixing container, and fluid dispensing valves with the inclusion of a wash bottle fluid container, filled with a cleaning solution, to rinse and sanitize the apparatus's fluid contacting surfaces and dispensing any flushed material, waste, drippings, etc. into the drip & waste container. The apparatus is highly portable by allowing for an optional on-board power source to power all on-board aspects of the apparatus enabling the device to be used in remote locations. The method of user interaction with the apparatus increases the speed of ordering by allowing multiple users to simultaneously and wirelessly interact with the device at a distance through the use of mobile computing devices, thereby providing convenience and saving time spent in the queue waiting to interact with the apparatus regardless of the user's current location.

The embodiments listed above are for illustration only and are not intended to be limiting. Other embodiments are recognized by reference to the description and to the drawings contained in this application.

The claimed invention is:

1. A fluid management apparatus comprising:

an arrangement of different fluid dispensing containers;

a fluid retriever device including a fluid receiving member that is repositionable between the different fluid dispensing containers so as to receive fluid from the different fluid dispensing containers;

a first motion actuator that moves the fluid receiving member in a first direction;

a second motion actuator that moves the fluid receiving member in a second direction; and a fluid mixing device in fluid communication with the fluid receiving member, the fluid mixing device being engaged with the first and/or second motion actuator in such a way that the respective motion actuator imparts mixing motion to the fluid mixing device.

2. The apparatus of claim 1, wherein the different fluid dispensing containers include a respective fluid retrieval valve and the first motion actuator and/or second motion actuator is(are) operably engaged with the fluid retrieval valves.

3. The apparatus of claim 1, wherein the fluid mixing device includes a dispensing valve and the first motion actuator and/or second motion actuator is(are) operably engaged with the dispensing valve.

4. The apparatus of claim 1, further comprising a third motion actuator that moves the fluid receiving member in a third direction.

5. A method of retrieving and mixing fluids, the method comprising:

dispensing fluid from an arrangement of different fluid dispensing containers by repositioning a fluid receiving member between the different fluid dispensing containers so as to receive fluid from the different fluid dispensing containers;

imparting motion to a first motion actuator that repositions the fluid receiving member in a first direction;

imparting motion to a second motion actuator that repositions the fluid receiving member in a second direction; and mixing the received fluids in a fluid mixing device in fluid communication with the fluid receiving member by imparting motion to the first and/or second motion actuator, causing the fluid mixing device to move and mix the received fluids.

6. The method of claim 5, wherein the different fluid dispensing containers include a respective fluid retrieval valve and the first motion actuator and/or second motion actuator is(are) operably engaged with the fluid retrieval valves.

7. The method of claim 5, wherein the fluid mixing device includes a dispensing valve and the first motion actuator and/or second motion actuator is(are) operably engaged with the dispensing valve.

8. The method of claim 5, further comprising imparting motion to a third motion actuator that moves the fluid receiving member in a third direction.

* * * * *